US007592747B1

(12) United States Patent
Beach et al.

(10) Patent No.: US 7,592,747 B1
(45) Date of Patent: Sep. 22, 2009

(54) PIEZOELECTRICALLY ENHANCED PHOTOCATHODE

(75) Inventors: Robert A. Beach, Altadena, CA (US); Shouleh Nikzad, Valencia, CA (US); Robert P. Strittmatter, Pasadena, CA (US); Lloyd Douglas Bell, Sunland, CA (US)

(73) Assignee: The United States of America as represented by the National Aeronautics and Space Administration, Washington, DC (US)

( * ) Notice: Subject to any disclaimer, the term of this patent is extended or adjusted under 35 U.S.C. 154(b) by 677 days.

(21) Appl. No.: 11/056,633

(22) Filed: Feb. 9, 2005

(51) Int. Cl.
*H01J 40/06* (2006.01)

(52) U.S. Cl. ..... 313/542; 313/544; 313/532; 313/534

(58) Field of Classification Search ..... 313/523–525, 313/527, 103 R, 103 CM, 105 CM, 537, 313/544, 530–536, 541, 542; 250/214 VT, 250/207, 216, 226, 234; 357/9, 18, 301; 438/427

See application file for complete search history.

(56) References Cited

U.S. PATENT DOCUMENTS

| | | | | | |
|---|---|---|---|---|---|
| 4,967,089 | A | * | 10/1990 | Reilly et al. | 250/493.1 |
| 5,321,713 | A | * | 6/1994 | Khan et al. | 372/45.01 |
| 5,557,167 | A | * | 9/1996 | Kim et al. | 313/542 |
| 5,657,335 | A | * | 8/1997 | Rubin et al. | 372/44.01 |
| 5,697,826 | A | * | 12/1997 | Kim et al. | 445/58 |
| 5,982,093 | A | * | 11/1999 | Nihashi et al. | 313/542 |
| 2002/0093288 | A1 | * | 7/2002 | Spencer et al. | 313/523 |

* cited by examiner

*Primary Examiner*—Joseph L Williams
*Assistant Examiner*—Elmito Breval
(74) *Attorney, Agent, or Firm*—Mark Homer

(57) ABSTRACT

A photocathode, for generating electrons in response to incident photons in a photodetector, includes a base layer having a first lattice structure and an active layer having a second lattice structure and epitaxially formed on the base layer, the first and second lattice structures being sufficiently different to create a strain in the active layer with a corresponding piezoelectrically induced polarization field in the active layer, the active layer having a band gap energy corresponding to a desired photon energy.

27 Claims, 4 Drawing Sheets

PIEZOELECTRICALLY ENHANCED PHOTOCATHODE

ORIGIN OF THE INVENTION

This invention described herein was made in the performance of work under a NASA contract, and is subject to the provisions of Public Law 96-517 (35 U.S.C. § 202) in which the Contractor has elected not to retain title.

BACKGROUND OF THE INVENTION

A photodetector can be a monolithic semiconductor structure or a heterostructure consisting of a photocathode and an electron sensor. The electron sensor in the heterostructure photodetector can be an electron-bombarded charge coupled device (EBCCD) or a micro-channel plate (MCP). The photocathode and the electron sensor generally are mutually facing planar devices separated by a vacuum gap across which a large (e.g., 10 kV) electric field is imposed. As photons from a field of view strike the photocathode, electrons are emitted from the surface of the photocathode facing the electron sensor. The emitted electrons are accelerated across the vacuum gap and strike the electron sensor. The electron sensor amplifies the electron current. In the case of the EBCCD, amplification of the electron current is obtained by exploiting the quantum yield of the semiconductor material of the EBCCD. In the case of the MCP, amplification is obtained by providing the interior surfaces of the glass tubes constituting the MCP with a high electron yield surface. Each incoming electron ricochets on a tube interior surface many times, producing as many as 300 additional electrons for each incoming electron.

The performance of the photodetector is limited by the efficiency with which the photocathode emits electrons in response to incoming photons. The photocathode is generally a planar semiconductor crystal. Each incident photon creates a hole-electron pair in the semiconductor crystal by elevating an electron from the valence band to the conduction band, leaving a hole in the valence band. Generally, a semiconductor material having a bandgap energy corresponding to the infrared region (such as GaAs) does not readily emit electrons from its surface when struck by photons, due to an energy barrier that arises at the crystal surface of the semiconductor. In order for surface emission to occur, the electron must overcome both the work function of the surface and the band gap energy of the semiconductor. Conventionally, this problem is overcome by "activating" the surface of the photocathode in such a manner that this energy barrier is overcome. In the case of a UV or IR photodetector, the photocathode can be a group III semiconductor or group III-V compound semiconductor, and the "activation" consists of depositing a thin Cesium (Cs) coating on the crystal surface. The Fermi levels in the Cs and semiconductor layers equilibrate at the interface between the layers, forcing the valence and conduction band structures in the semiconductor layer to "bend" so much that the conduction band at the surface is below the Fermi level and the bulk conduction band bottom lies above the vacuum level at the surface. This condition is favorable for electron emission from the photocathode surface because electrons excited in the bulk can diffuse toward the surface where they can tunnel or be ballistically emitted from the crystal into the vacuum.

The problem is that the Cs coating step can only be performed in a vacuum, because Cs is highly reactive with oxygen and therefore unstable in oxygen containing environments. The surface activation of the photocathode is therefore extremely difficult and expensive to perform, and the "cesiated" device is neither robust nor permanent. It is unstable and not long lasting, being subject to attack when exposed even slightly to oxygen atoms or molecules. On the other hand, Cesium coating of the GaAs surface provides highly desirable photocathode attributes, specifically (a) a high yield of photoelectrons when under illumination (because it has a short photon absorption length for efficient photon absorption, a long electron diffusion length to minimize photoelectron losses, and a small or negative electron affinity), and (b) high conductivity to avoid charging due to electron loss by photoemission. It has seemed that such desirable attributes could only be realized through the expensive and impermanent Cesium coating step. The result is that the photocathode is chemically unstable. What is needed, therefore, is another way of activating the photocathode that realizes all of the foregoing desirable attributes (high yield and high conductivity) while at the same time providing a structure that is highly stable and robust both chemically and physically (unlike cesiated GaAs structures).

In addition, it would be desirable to have a material system that is activated for photoelectron emission as mentioned above in which the photon absorption spectrum can be independently adjusted without compromising or sacrificing any of the foregoing desired attributes. In particular, for some space applications it is important that the sensor be blind to visible light (e.g., from the sun), and therefore it is useful to be able to set the photon absorption spectrum of the detector to exclude certain wavelength regions while including desired ones.

SUMMARY OF THE INVENTION

A photocathode, for generating electrons in response to incident photons in a photodetector, includes a base layer having a first lattice structure and an active layer having a second lattice structure and epitaxially formed on the base layer, the first and second lattice structures being sufficiently different to create a strain in the active layer with a corresponding piezoelectrically induced polarization field in the active layer, the active layer having a band gap energy corresponding to a desired photon energy.

In one implementation, the base and active layers are each formed of p-type AlGaN, and the aluminum mole fraction in the base layer exceeds the aluminum mole fraction in the active layer by an amount sufficient to create the strain. In this implementation, the aluminum mole fraction y of said active layer fixes the band gap energy and corresponding spectral cut-off frequency of said photocathode, and the aluminum mole fraction x of said base layer is selected to provide the requisite difference between the mole fractions.

DETAILED DESCRIPTION OF THE INVENTION

Figure 1:
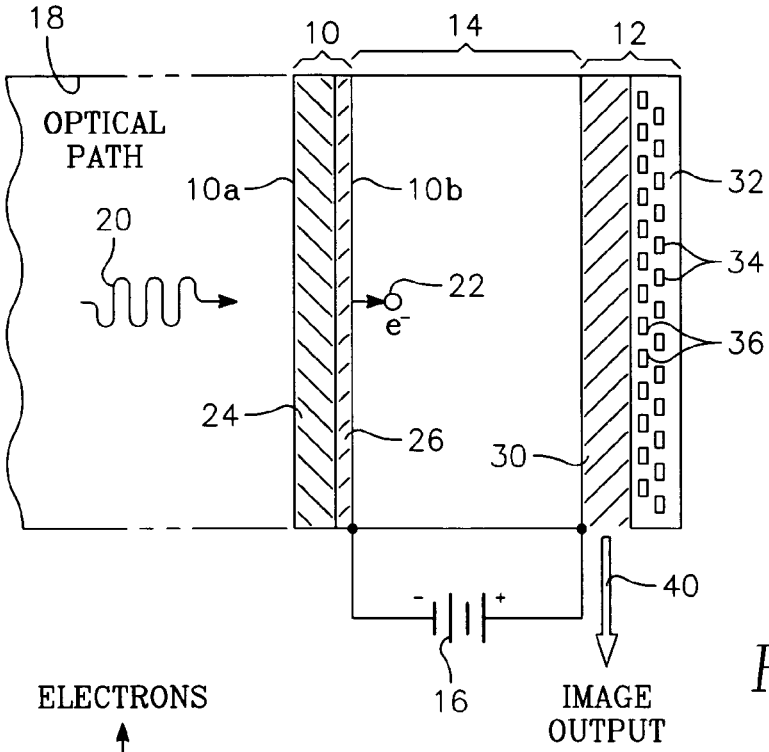
FIG. 1 is a simplified cut-away cross-sectional side view of a photodetector having a photocathode embodying the invention and an electron bombarded charge coupled device (EBCCD) as the electron sensor of the photodetector.

We have discovered a class of highly efficient photocathodes that do not require deposition an activating metal such as Cesium, and are impervious to exposure to atmosphere and may therefore be manufactured in a relatively efficient and inexpensive manner. Specifically, we found that certain semiconductor crystals such as nitrides of Group III elements have particularly favorable piezo-electric behavior that enables surface activation of such a crystal for purposes of photoelectron surface emission. Such piezoelectric activation is accomplished by inducing piezo-electric strain in the crystal surface from which photoelectrons are to be emitted. The strain is induced by epitaxially growing a p-doped thin Group III-nitride layer on a base p-doped Group III-nitride layer (e.g., by molecular beam epitaxial deposition), but providing sufficiently different lattice constants in the two layers to generate the desired crystal strain in the thin layer. The difference in lattice constants is obtained and controlled by the difference in mole fraction of a second Group III element in the two Group III-nitride layers. The piezoelectric effect from the lattice strain induces high polarization fields near the surface. This piezoelectric polarization, in conjunction with any spontaneous polarization, can lead to a 2-dimensional electron gas at the surface, producing the desired conditions for electron emission from the surface. (Spontaneous polarization is the polarization field in the crystal when it is not strained and at some nominal temperature).

Specifically, and as one working example of the invention, the two layers can be formed of the ternary system of aluminum gallium nitride (AlGaN). In this example, the mole fraction of Al is different in the respective layers, and can even be zero in one of them. The resulting strain in the thin deposited epitaxial crystal layer contributes to the net polarization fields in the crystal that are compensated by a redistribution of electrons in the surface layer to form the dense 2-dimensional electron gas. The resulting bending of the crystalline band structure drives the conduction band at the crystal surface below the Fermi level and the vacuum level at the surface below the bottom of the bulk conduction band. This condition is sufficient for photoelectron surface emission.

The 2-dimensional electron gas at the photocathode surface can be controlled by controlling the differential aluminum content in the adjacent layers in the AlGaN ternary system. Photocathode performance parameters such as photon absorption efficiency are controlled by controlling the density of the p-type impurities in each of the two layers. We have discovered a highly advantageous feature in the AlGaN ternary system, namely that the Aluminum content can be varied to choose the band gap energy without significantly affecting the photon absorption efficiency, over a very large range of Aluminum content, corresponding to a band gap energy range of 3.4 eV to 6.2 eV. Thus, separate independent control over different performance parameters (absorption efficiency vs. band gap energy) of the AlGaN photocathode is attained by varying the Aluminum content and by varying the p-type dopant concentration.

A significant advantage of the AlGaN ternary system is that it is very stable chemically and robust physically, so that the piezo-electric strain-activated AlGaN photocathode is relatively permanent and fairly immune to attack from the exposure to atmosphere, even at elevated temperatures. This feature permits thermal degassing of atmosphere-exposed Group III-nitride photocathode materials, a significant advantage.

An even greater advantage of the AlGaN ternary system is its strong piezoelectric constants (which are an order of magnitude greater than GaAs crystals). Piezoelectricity in AlGaN is a non-isotropic phenomenon characterized by a tensor relating strain in 3-dimensional space to corresponding polarization vector components. The preferred epitaxial growth direction is along the piezoelectrically active axis of the crystal. In AlGaN, a relatively small amount of lattice strain produces a large change in polarization which can lead to the formation of a dense 2-dimensional electron gas at the surface of the strained layer (which may be referred to as a piezo-induced surface charge). For example, a 10% change in aluminum content in one of the two AlGaN layers (relative to the other layer) can double the piezo-induced surface charge. Determination of the band gap energy is still independent of the surface charge. The bandgap is set by the selection of the aluminum content in the active AlGaN layer, while the mismatch in aluminum content of the two layers is selected to achieve a particular level of strain in the thin layer, independently determining the amount of surface charge. In addition, photon absorption is controlled independently by the p-type doping level of the AlGaN crystal.

The invention is useful in a heterostructure photodetector that includes a photocathode and an electron sensor such as an MCP or EBCCD separated by a vacuum from the photocathode. The invention is also applicable to a monolithic semiconductor photodetector.

Referring to FIG. 1, a photodetector consists of a planar photocathode 10 facing a planar electron sensor 12 across a vacuum gap 14. A voltage source 16 maintains a high voltage (e.g., 10 kV to 20 kV) across the vacuum gap 14. An optical path 18 guides light, including a photon 20 from a field of view to an exterior surface 10*a* of the photocathode 10. In response to the incident photon 20, the photocathode 10 emits a photo-excited electron (photo electron) 22 from its interior surface 10*b* facing the electron sensor 12. The photoelectron 22 is accelerated across the vacuum gap 14 and strikes the electron sensor 12 with large kinetic energy (10 keV to 20 keV).

The photocathode 10 consists of a base layer 24 that includes the photon-illuminated surface 10*a*. The base layer is a semiconductor crystal. An active layer 26 epitaxially grown on the base layer 24 includes the electron-emitting surface 10*b* and has a band gap energy corresponding to the desired spectral response. A band gap structure favorable for surface emission of electrons and a large surface electron charge at the electron-emitting surface 10*b* is attained by piezo-electrically induced fields in the active layer. These fields are established by a designed mismatch between the lattice constants of the two layers 24, 26.

In an exemplary embodiment, each of the two layers is a p-type Group III-nitride semiconductor, and the fractional content of a selected Group III species is different in the two layers 24, 26. As one example, each of the two layers is formed of the p-doped AlGaN ternary system, in which the aluminum content is different in each of the two layers 24, 26. Thus, in an exemplary embodiment, the base layer 24 is $Al_xGa_{1-x}N$ while the active layer 26 is $Al_yGa_{1-y}N$. In the case of the active layer 26, the aluminum mole fraction y is selected to provide the desired band gap energy and corresponding spectral cut-off frequency. In the case of the base layer 24, the aluminum mole fraction x is selected to provide the desired difference in aluminum content between the two layers 24, 26 to produce the desired lattice strain for attaining the corresponding band "bending" and electron surface charge (to enable electron emission from the photocathode emission surface 10*b*). The key to this latter feature is the difference between the aluminum mole fractions x and y of the two layers.

Generally, the aluminum content of the base layer 24 exceeds that of the active layer 26, so that x>y. The active layer aluminum mole fraction y may be zero in some implementations, so that the active layer 26 is GaN in such cases.

Figure 2:
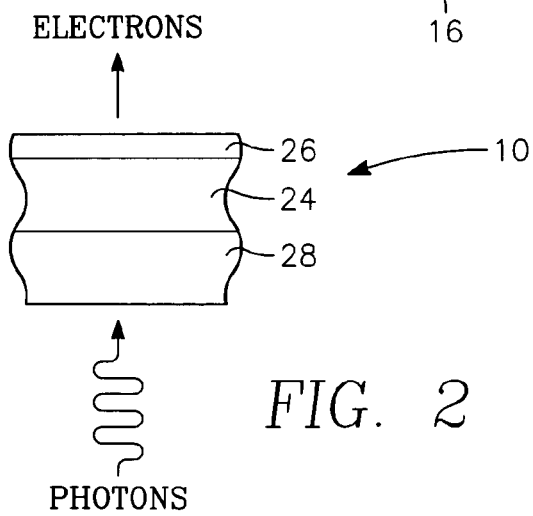
FIG. 2 is cross-sectional side view of one implementation of the photocathode including a substrate.

As illustrated in FIG. 2, the photocathode 10 may further include a substrate 28 on which the base and active layers 24, 26 are supported. The substrate 28 is preferably of a material that is at least relatively transparent at the wavelength range of interest. For example, for detection of UV light, the substrate 28 may be MgF, which is transmissive above 120 nm. For wavelengths at 200 nm, the substrate 28 may be sapphire. The base and active layers 24, 26 may be epitaxially grown on a sapphire substrate and then transferred to a substrate of a material having the desired band gap energy (e.g., MgF). The combined thickness of the base and active layers 24, 26 may be on the order of several hundred angstroms. The desired thickness is limited in order to limit recombination losses of photo electrons generated in the base layer 24.

In the implementation of FIG. 1, the electron sensor is an EBCCD, consisting of a semiconductor CCD channel layer 30 and an overlying insulator layer 32 in which overlapping upper and lower level polysilicon CCD electrodes 34, 36 are formed and driven by respective phases of a two-phase signal. The CCD electrodes 34, 36 are electrically driven by the two-phase signal so as to form a sequence of potential wells in the semiconductive channel layer 30 in which photo electrons from the photocathode 10 are collected and then transferred laterally as an image output 40. The spacing between adjacent potential wells (i.e., the spacing of the CCD electrodes 36) determines the resolution of the detected image at the output 40. There is some amplification in the EBCCD 12 of the electron current from the photocathode 10. This is due to quantum yield in the EBCCD from the incidence of high energy (10 keV) photo electrons from the photocathode 10.

Figure 3:
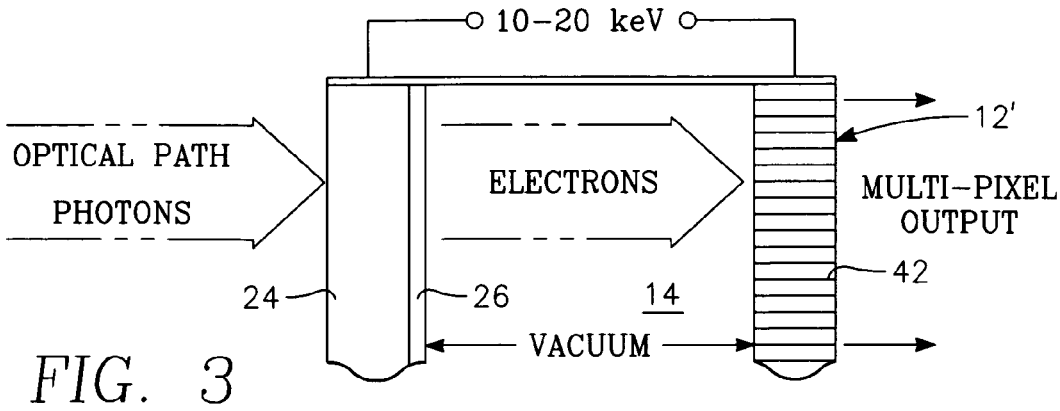
FIG. 3 is a simplified cut-away cross-sectional side view of a photodetector having a photocathode embodying the invention and a microchannel plate as the electron sensor of the photodetector.

In the implementation of FIG. 3, the electron sensor is an MCP 12' rather than an EBCCD. The MCP 12' of FIG. 3 is formed of glass and has many parallel tubular holes 42 formed therethrough parallel to the direction of electron propagation through the vacuum gap 14. The interior surface of each tubular hole 42 is coated with a thin film of a low work function metal. Each photo electron passing through a tubular hole 42 tends to ricochet many times off the interior hole surface, these collisions generating additional electrons, so that each incident photoelectron generates as many as 300 electrons in a given one of the tubular holes 42. This amplifies the electron current.

The spacing between adjacent tubular holes 42 determines the resolution of the detected image.

Figure 4:
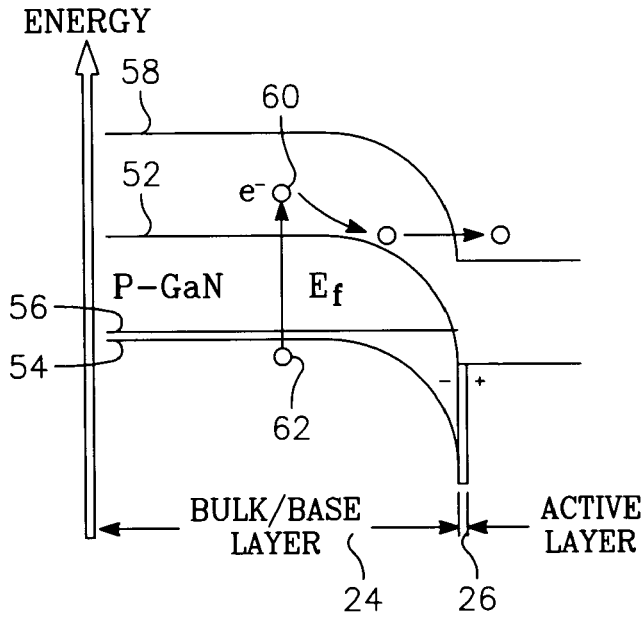
FIG. 4 is a graph illustrating the semiconductor energy band structure of the photocathode of FIG. 1.

The semiconductor band structure of the photocathode 10 of FIG. 1 is illustrated in FIG. 4, which shows the piezoelectric effect of the lattice strain in the active layer 26. The band diagram of FIG. 4 applies, for example, to implementations of the photocathode 10 of FIG. 1 employing the p-doped AlGaN ternary system discussed above. The vertical axis of the graph of FIG. 4 corresponds to energy. The horizontal axis corresponds to location, extending from the base layer 24 beginning at the left and ending at the vacuum boundary of the active layer 26 on the right side of the graph. In the bulk or base layer 24 the band structure has a conduction band edge 52 at a higher energy and a valence band edge 54 at a lower energy separated from the conduction band edge by the band gap energy. The Fermi energy level 56 lies between the conduction and valence band edges 52, 54. The top edge of the conduction band corresponds to the vacuum level 58. FIG. 4 indicates a charge accumulation near the surface of the active layer 26 caused by spontaneous and piezoelectrically induced polarization from the lattice strain in the active layer 26. This charge accumulation, arising from the lattice mismatch between the base and active layers 24, 26, causes the desired band bending, in which the band structure decreases in energy near the interface between the base layer 24 and the active layer 26. As a result, the conduction band edge 52 in the active layer 26 is below the Fermi energy level 56, while the vacuum level at the active layer 26 is below the conduction band edge 52 of the bulk or base layer 24. An electron-hole pair 60, 62 is created when a photon incident in the base layer 24 excites the electron 60 from the valence band into the conduction band, creating the hole 62 in the valence band. As indicated in the band diagram of FIG. 4, the photo-excited electron 60 passes from the conduction band of the base layer 24 (the bulk conduction band), across the surface dipole of the active layer 26 and leaves the surface of the active layer 26 to be emitted into the vacuum. The drawing of FIG. 4 shows that the conduction band in the active layer 26 is below the Fermi level, so that the active layer has a very high population of conduction band electrons. Secondly, the drawing of FIG. 4 shows that the vacuum level 58 at the active layer 26 is below the conduction band edge 52 of the bulk or base layer 24, so that conduction band electrons in the bulk or base layer 24 have sufficient energy to diffuse toward and be emitted from the surface of the active layer 26 into the vacuum.

Figure 5:
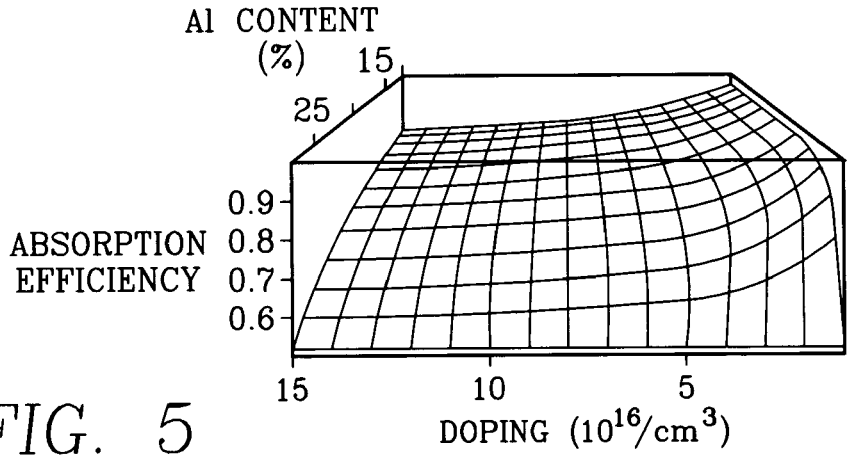
FIG. 5 depicts a three-dimensional graph illustrating photon absorption efficiency as a function of p-type dopant impurity concentration and as a function of aluminum content.

FIG. 5 is a three-dimensional graph showing how the photon absorption efficiency of the base layer 24 varies with aluminum content and p-type dopant concentration. The graph of FIG. 5 shows a direct increase in photon absorption efficiency as dopant concentration decreases but little change over a broad range of aluminum content. Specifically, in the AlGaN ternary system, as the p-type dopant concentration decreases from $15\times10^{16}/cm^3$ to $10\times10^{16}/cm^3$, the photon absorption efficiency increases from about 0.5 to over 0.9 provided the aluminum content of the base layer is between about 15% and 30%. Above 30% aluminum content, the graph of FIG. 5 shows that the absorption efficiency falls off toward zero as the aluminum content increases. This implies a very wide range within which the aluminum content of the base layer 24 may be varied (to control the response wavelength) without reducing absorption efficiency.

Figure 6:
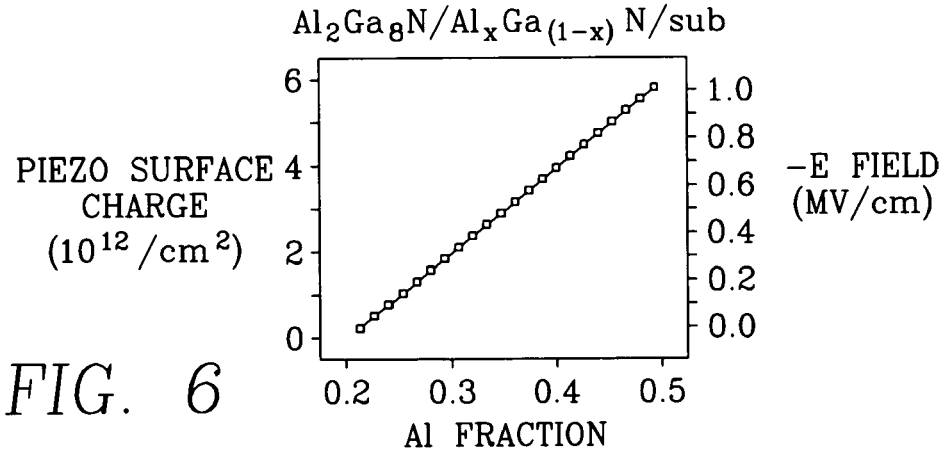
FIG. 6 is a graph illustrating piezo surface charge density (and the corresponding polarization electric field magnitude) as a function of the aluminum content of the base layer for a fixed aluminum content in the active layer.

FIG. 6 is a graph illustrating how the piezo surface charge in the active layer 26 (or, equivalently, the strain-induced electric polarization field) depends upon the difference in aluminum content of the base and active layers 24, 26. The greater the difference in aluminum content between the two layers, the greater the mismatch between lattice constants and therefore the greater the lattice strain in the active layer 26, which translates into greater piezo surface charge. In the working example of FIG. 6, the aluminum mole fraction x in the base layer 24 is varied while the aluminum mole fraction y of the active layer 26 is fixed at 0.2 to provide an absorption edge cut-off wavelength at 300 nm. FIG. 6 shows that as the base layer aluminum content increases from a level equal to that of the active layer 26 (0.2) up to 0.50, the piezo surface charge increases from zero to $6\times10^{12}/cm^2$, while the polarization field in the active layer increases from zero to about 1 millivolt/cm. This field results in significant charge redistribution as electrons move to cancel the fields. The resulting band bending (FIG. 4) drives the surface conduction band down below the Fermi level. That is the desired result for improving the emissive qualities of the active layer surface.

Figure 7:
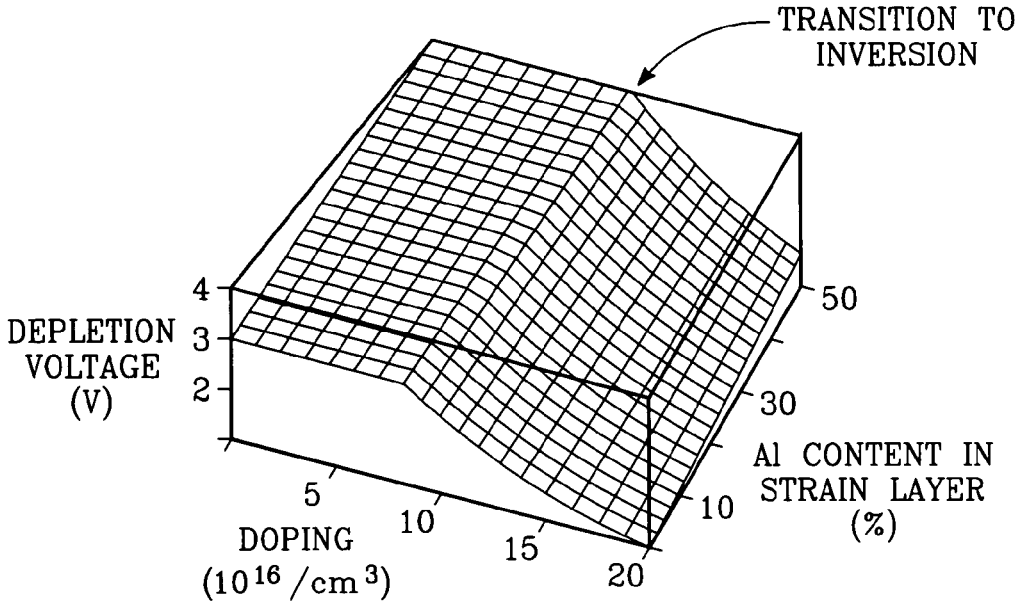
FIG. 7 depicts a three-dimensional graph illustrating depletion voltage in the photocathode of FIG. 1 as a function of p-type dopant impurity concentration and as a function of aluminum content in the active layer, where a 10% difference is maintained between the aluminum contents of the base and active layers.

FIG. 7 is a three-dimensional graph illustrating the depletion voltage of the active layer surface (the voltage required to deplete the surface of carriers) as a function of dopant concentration and as a function of aluminum content of the active layer. FIG. 7 shows that the depletion voltage is primarily affected by the dopant concentration. FIG. 7 shows that at very low dopant levels (less than $5\times10^{16}/cm^3$), the p-type active layer surface has a very high depletion voltage and is therefore strongly inverted, with high levels of electron accumulation. Too much inversion can lead to greater scattering of photo electrons, reducing their energy and lowering the photocathode quantum efficiency. On the other hand, a very high level of p-type dopant (e.g., about $20\times10^{16}/cm^3$) results in very low electron accumulation (low depletion voltage) due to cancellation of the piezoelectric field. The corner or crease in the surface depicted in the 3-dimensional graph of FIG. 7 is labeled "transition to inversion" and occurs at a dopant level of about $10\times10^{16}/cm^3$, which is within the practical doping range for p-type AlGaN.

From the foregoing description of FIGS. 4 through 7, the term "activation" of the active layer 26 by strain-induced piezoelectrical polarization can be defined as achievement of any one or combination of the following characteristics:

(a) the aluminum mole fractions of the two layers 24, 26 are sufficiently different to bend the band structure (FIG. 4) of the photocathode so that the conductivity band bottom edge in the bulk or base layer 24 is higher in energy than the conduction band/vacuum boundary at the surface of the active layer 26;

(b) the aluminum mole fractions of the two layers 24, 26 are sufficiently different to bend the band structure (FIG. 4) so that the top of the conduction band in the active layer 26 is below the Fermi level;

(c) the aluminum mole fractions of the two layers 24, 26 are sufficiently different to create a strain in the active layer that produces a piezoelectrically induced polarization field of 0.05 to 1.0 millivolts per centimeter in the active layer;

(d) the aluminum mole fractions of the two layers 24, 26 are sufficiently different so that the strain-induced piezoelectric polarization fields produce an electron surface charge density in the active layer from about 0.05 to 20.0×10E12 electrons per square centimeter.

The foregoing attributes (a) through (d) are symptoms of the basic desirable feature for the photocathode: very low or negative electron affinity of the electron emission surface 10*b* of the active layer 26. Thus, the term "activation" may be defined as a sufficiently low or negative electron affinity in the active layer 26 to enable photoelectrons created in the base layer 24 to diffuse toward the electron emission surface and either tunnel or be ballistically ejected therefrom.

Figure 8:
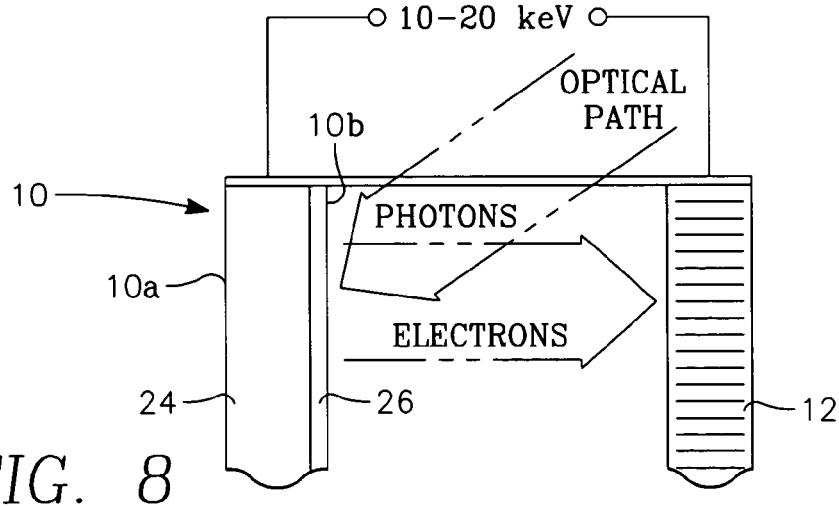
FIG. 8 depicts a reflection configuration implementation of a photodetector employing the photocathode of FIG. 1.

The embodiments of FIGS. 1-3 corresponding to transmission configuration devices in which light must be transmitted through the base layer 24 to reach the active layer 26. FIG. 8 illustrates a reflection configuration device in which incoming photons strike the active layer 26 directly on its electron emission surface 10*b*, causing the electron emission from the emission surface 10*b* through the vacuum gap 14 to the electron sensor 12.

Figure 9:
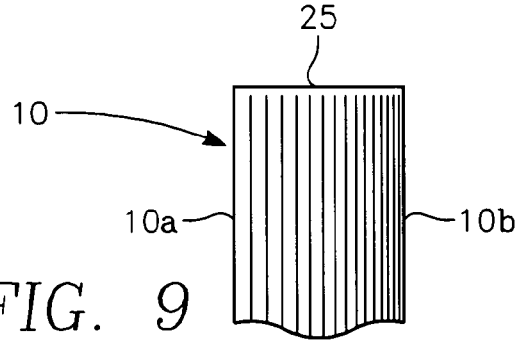
FIG. 9 depicts a single layer version of the photocathode having an aluminum concentration that varies with depth.
Figure 10:
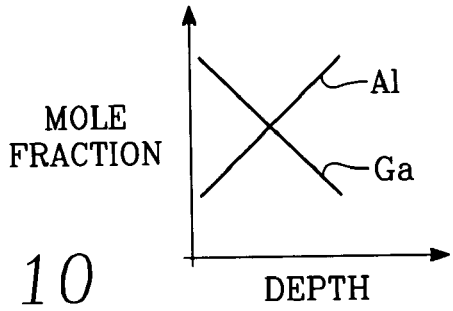
FIG. 10 is a graph corresponding to FIG. 9 depicting aluminum and gallium concentration as a function of depth.

FIG. 9 depicts a modification of the photocathode 10 of FIG. 1 in which a single layer 25 replaces the discrete layers 24, 26. If the single layer 25 consists of AlGaN, for example, the aluminum content increases continuously from a minimum near the photon-illuminated surface 10*a* up to a maximum at the electron emission surface 10*b*, so as to cause the desired amount of lattice strain near the electron emission surface 10*b*. The shading in FIG. 9 depicts aluminum density in the AlGaN material. FIG. 10 is a graph illustrating the complementary aluminum and gallium content of the single layer 25 of FIG. 9 as a function of depth, showing the continuous transition in aluminum content.

Figure 11:
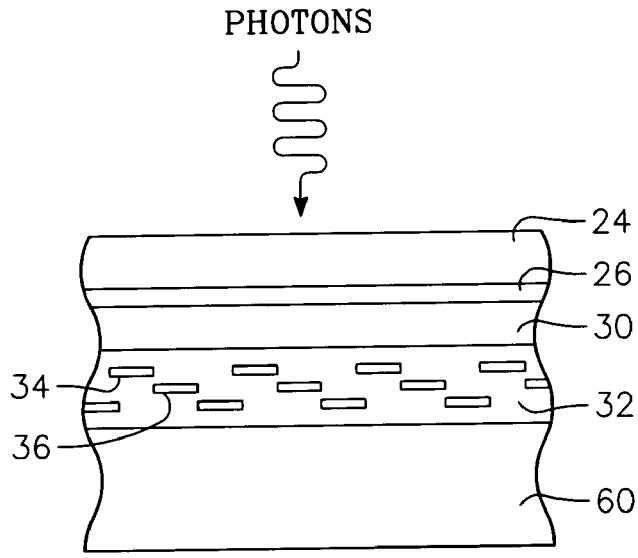
FIG. 11 is a simplified cut-away cross-sectional view of a monolithic photodetector employing the photocathode of FIG. 1 and a CCD electron sensor.

The foregoing description mainly has concerned photodetectors of the type having a discrete photocathode and an electron sensor separated from the photocathode by a vacuum gap. However, the invention can be employed in a monolithic photodetector in which the photocathode and the electron sensor are not separate. For example, FIG. 11 illustrates how the photocathode 10 of FIG. 1 can be deposited directly on the EBCCD 12 of FIG. 1. The entire structure, including the photocathode base layer 24, the photocathode active layer 26, the CCD channel layer 30 and the CCD insulator layer 32 (including the CCD electrodes 34, 36) can be formed, for example, as a monolithic semiconductor device on a substrate 60. Alternatively, the structure may be a hybrid one in which the photocathode and EBCCD are fabricated separately and then bonded together.

Figure 12:
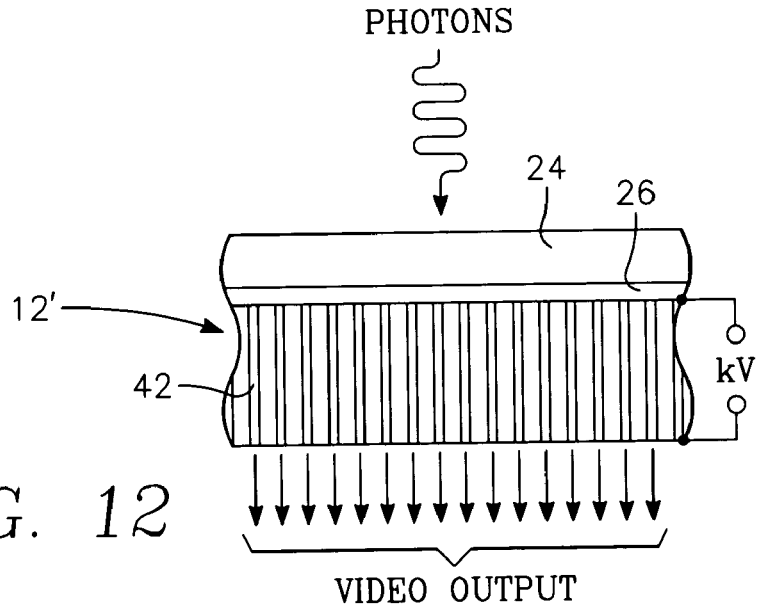
FIG. 12 is a simplified cut-away cross-sectional view of a monolithic photodetector employing the photocathode of FIG. 3 and a microchannel plate electron sensor.

FIG. 12 illustrates an arrangement similar to that of FIG. 11, except that the electron sensor is the MCP 12' of FIG. 3. In FIG. 12, the photocathode layers 24, 26 are placed directly on the MCP 12'.

While the invention has been described in detail with reference embodiments employing crystalline materials, other embodiments may be made using polycrystalline materials. While the invention has been in detail with reference to embodiments employing elements described as planar device, the surface finish in various embodiments may be very smooth or textured or rough.

While the invention has been described in detail by specific reference to preferred embodiments, it is understood that variations and modifications thereof may be made without departing from the true spirit and scope of the invention.

What is claimed is:

1. A photocathode for generating electrons in response to incident photons in a photodetector, said photocathode comprising:

a base layer having a first lattice structure, wherein said base layer has a p-type conductivity impurity concentration corresponding to a photon absorption efficiency between about 0.5 and about 0.95;

an active layer, being an outermost layer, having a second lattice structure and epitaxially formed on said base layer, said first and second lattice structures being sufficiently different to create a strain in said active layer with a corresponding polarization field in said active layer, said active layer having a band gap energy corresponding to a desired photon energy.

2. The photocathode of claim 1 wherein said base and active layers each comprises p-type AlGaN, and wherein the mole fractions of aluminum in said base and active layers are x and y, respectively, and wherein x exceeds y by an amount sufficient to create said strain.

3. The photocathode of claim 2 wherein said, active layer has a p-type conductivity impurity concentration corresponding to a transition to inversion of said electron emission surface.

4. The photocathode of claim 3 wherein said impurity concentration is on the order of about $10^{17}$ per cubic centimeter.

5. The photocathode of claim 2 wherein the aluminum mole fraction y of said active layer fixes the band gap energy and corresponding spectral cut-off frequency of said photocathode, and the aluminum mole fraction x of said base layer is selected to provide the difference between said mole fractions.

6. The photocathode of claim 5 wherein said base layer comprises a collection external surface for receiving incident photons and a base intermediate surface opposite said collection external surface and facing said active layer, and said active layer comprises an active intermediate surface epitaxially joined with said base intermediate surface and an electron emission external surface opposite said active intermediate surface.

7. The photocathode of claim 6 wherein the difference between the base and active layer aluminum mole fractions x and y is sufficient to bend the conduction band/vacuum boundary in said active layer below the conduction band bottom edge of said base layer.

8. The photocathode of claim 6 wherein the ratio between the base and active layer aluminum mole factions x and y ranges between an amount greater than 1 and up to 5, corresponding to a range in piezoelectrically induced surface charge near said emission surface of between an amount greater than zero up to about $6\times10^{12}$ per square cm.

9. The photocathode of claim 6 wherein the ratio between the base and active layer aluminum mole factions x and y ranges between an amount greater than 1 and up to 5, corresponding to a range in a piezo-induced polarization field in said active layer from an amount greater than zero and up to 1 millivolt per centimeter.

10. The photocathode of claim 1 wherein said base layer comprises a collection external surface for receiving incident photons and a base intermediate surface opposite said collection external surface and facing said active layer, and said active layer comprises an active intermediate surface epitaxially joined with said base intermediate surface and an electron emission external surface opposite said active intermediate surface.

11. The photocathode of claim 10 wherein the difference between said first and second lattice structures is sufficient to bend the conduction band/vacuum boundary in said active layer below the conduction band bottom edge of said base layer.

12. The photocathode of claim 1 wherein said polarization field is sufficient to produce an electron gas near said emission surface of said active layer having a surface charge density on the order of about $10^{12}$ electrons per square centimeter.

13. The photocathode of claim 1 wherein said impurity concentration is on the order of about $10^{17}$ per cubic centimeter.

14. The photocathode of claim 1 wherein said polarization field is sufficient to bend the band structure of the photocathode so that the bulk conductivity band bottom edge is higher in energy than the conduction band/vacuum boundary at an electron emission surface of the photocathode.

15. The photocathode of claim 1 wherein said strain is sufficient to bend the band structure of the photocathode so that the top of the conduction band near an electron emission surface of the photocathode is below the Fermi energy level.

16. The photocathode of claim 1 wherein said strain is sufficient to produce a piezoelectrically induced polarization field of about 0.05 to about 1.0 millivolt per centimeter near an electron emission surface of said photocathode.

17. The photocathode of claim 1 wherein said strain is sufficient to produce near an electron emission surface of said photocathode an electron surface charge density within a range of about $0.05\times10^{12}$ to about $20.0\times10^{12}$ electrons per square centimeter.

18. The photocathode of claim 1 wherein said strain is sufficient to reduce an electron affinity of said photocathode to a zero or negative affinity.

19. The photocathode of claim 18 wherein said electron affinity is sufficiently low or negative to enable photoelectrons created in the photocathode to diffuse toward an electron emission surface of said photocathode and be ballistically ejected therefrom.

20. A photodetector comprising:

photocathode comprising (a) a base layer having a first lattice structure, wherein said base layer has a p-type conductivity impurity concentration corresponding to a photon absorption efficiency between about 0.5 and about 0.95 and (b) an active layer, being an outermost layer of the photocathode, having a second lattice structure and epitaxially formed on said base layer, said first and second lattice structures being sufficiently different to create a strain in said active layer with a corresponding piezoelectrically induced polarization field in said active layer, said active layer having a band gap energy corresponding to a desired photon energy;

an electron sensor facing said active layer.

21. The photodetector of claim 20 wherein said base and active layers each comprises p-type AlGaN, and wherein the mole fractions of aluminum in said base and active layers are x and y, respectively, and wherein y exceeds x by an amount sufficient to create said strain.

22. The photodetector of claim 21 wherein the aluminum mole fraction y of said active layer fixes the band gap energy and corresponding spectral cut-off frequency of said photocathode, and the aluminum mole fraction x of said base layer is selected to provide the difference between said mole fractions.

23. The photodetector of claim 20 wherein said planar base layer comprises a collection external surface for receiving incident photons and a base intermediate surface opposite said collection external surface and facing said active layer, and said active layer, comprises an active intermediate surface epitaxially joined with said base intermediate surface and an electron emission external surface opposite said active intermediate surface.

24. The photodetector of claim 20 wherein said photocathode and said electron sensor are separated by a vacuum gap, said photodetector further comprising a high voltage source connected across said gap.

25. The photodetector of claim 20 wherein said photocathode and said electron sensor are joined together.

26. The photodetector of claim 25 wherein said photocathode and said electron sensor are formed together as a monolithic semiconductor structure.

27. The photodetector of claim 20 wherein said electron sensor comprises one of (a) an electron bombarded charge coupled device, (b) a microchannel plate.

* * * * *